United States Patent [19]

Braun et al.

[11] Patent Number: 4,688,047

[45] Date of Patent: Aug. 18, 1987

[54] METHOD AND APPARATUS FOR SENSING SATELLITE INK DROP CHARGE AND ADJUSTING INK PRESSURE

[75] Inventors: Hilarion Braun, Xenia; Linda M. Lush, Dayton; Ralph E. Antolik, III, Huber Heights, all of Ohio

[73] Assignee: Eastman Kodak Company, Rochester, N.Y.

[21] Appl. No.: 899,199

[22] Filed: Aug. 21, 1986

[51] Int. Cl.[4] ..... E01D 18/00

[52] U.S. Cl. ..... 346/1.1; 346/75

[58] Field of Search ..... 346/1.1, 75

[56] References Cited

U.S. PATENT DOCUMENTS

| | | | |
|---|---|---|---|
| 3,787,882 | 1/1974 | Fillmore et al. | 346/75 |
| 3,852,768 | 12/1974 | Carmichael et al. | 346/75 |
| 3,907,429 | 9/1975 | Kuhn et al. | 356/28 |
| 4,255,754 | 3/1981 | Crean et al. | 346/75 |
| 4,318,483 | 3/1982 | Lombardo et al. | 209/3.1 |
| 4,325,483 | 4/1982 | Lombardo et al. | 209/3.1 |
| 4,344,078 | 8/1982 | Houston | 346/75 |
| 4,368,474 | 1/1983 | Togawa et al. | 346/75 |
| 4,435,720 | 3/1984 | Horike et al. | 346/75 |
| 4,542,385 | 9/1985 | Jinnai et al. | 346/75 |

*Primary Examiner*—E. A. Goldberg
*Assistant Examiner*—Gerald E. Preston
*Attorney, Agent, or Firm*—Thomas H. Close

[57] ABSTRACT

In a continuous ink jet printer, the ink pressure is adjusted by detecting the fractional charge imparted to satellite drops, and adjusting the ink pressure as a function of the detected charge.

3 Claims, 4 Drawing Figures

FIG. 1

METHOD AND APPARATUS FOR SENSING SATELLITE INK DROP CHARGE AND ADJUSTING INK PRESSURE

TECHNICAL FIELD

The invention relates to continuous ink jet printing and more particularly to sensing the ink drop velocity and adjusting the ink pressure in response to measuring ink drop velocity in a continuous ink jet printer.

BACKGROUND

In a continuous ink jet printer, a continuous jet of electrically conductive ink is expelled from a microscopic orifice in a print head to form an ink filament. The ink jet is stimulated by a periodic disturbance induced by a stimulation signal applied to the ink jet head to cause the ink jet to reliably break up into an evenly spaced series of drops. An electrode located in the vicinity of the drop break-off point is employed to induce a controlled amount of charge on the ink jet filament. The induced charge is trapped on the ink drop as it separates from the filament, and the trajectory of the ink drop is determined by the interaction between the charged drop and local electric fields. In a binary type ink jet printer, drops are either charged or not. Charged drops are deflected along a catch trajectory into an ink drop catcher and uncharged drops proceed undeflected to an ink receiving surface such as paper. In another type of continuous ink jet printer, drops are selectively deflected along a plurality of printing trajectories, or a catch trajectory, depending upon the level of charge imparted to the drops by the charging electrodes.

In such continuous ink jet printers, the velocity of the ink drops can vary greatly due to variations in ink pressure in the ink jet print head, and variations in the viscosity of the ink. The ink viscosity may vary due to changes in temperature, due to evaporation of the solvent in the ink, or due to variations from batch to batch in the ink formulation.

It is desirable to control the velocity of ink drops in the ink jet printer because velocity of the drops has an influence on the size of the drops, and the momentum of the drops (which affects splashing). It is known to attempt to control the velocity of ink drops by keeping the ink pressure constant with an ink pressure servo. Unfortunately, changes in ink viscosity due to temperature and evaporation make this approach unsuccessful. Another approach, as outlined in U.S. Pat. No. 3,787,882 issued Jan. 22, 1974 to Filmore et al is to attempt to measure directly the velocity of the ink drops and to control the ink pressure to maintain a desired velocity. The apparatus disclosed by Filmore et al includes a pair of inductive sensors arranged along the line of flight of the charged ink drops. Circuitry is provided for measuring the time of flight of a group of charged drops between the two inductive sensors, to thereby determine the velocity of the drops. The ink pressure is adjusted by a servo loop with velocity as a feedback signal to produce a predetermined velocity.

One problem with such an arrangement is the sensitivity of the measurement that can be achieved. Because the sensitivity is low, a group of charged drops is employed to increase the signal. However, this reduces the accuracy of the measurement due to the uncertainty in the exact location of the drops. Furthermore, because the inductive sensors are in the vicinity of the drop charging electrodes, a large component of nose is induced on the sensors by induction from the drop charging electrodes. Another shortcoming is the need for interposing extra structures (the inductive sensors) in the region of the drop charging electrodes, an area where space is extremely limited in modern high resolution ink jet printers.

It is the object of the present invention to provide a means for sensing the velocity of ink drops in a continuous ink jet printer and for adjusting the ink pressure in response to the measured velocity that is free of the shortcomings noted above.

DISCLOSURE OF THE INVENTION

The objects of the invention are achieved by charging the ink jet, stimulating the ink jet to produce satellite drops, detecting the fractional charge imparted to the satellite drops, and adjusting the ink pressure as a function of the detected fractional charge. In a preferred mode of practicing the invention, the ink jet printer is a continuous binary type printer. The ink jet is charged to a level such that when they are produced, the satellite drops have a higher charge to mass ratio than the main drops, and are deflected into a catcher. The charge carried by the main drops is measured by an electrometer located in a storage and start up station to detect the charge carried away by the satellite drops.

BRIEF DESCRIPTION OF THE DRAWINGS

FIG. 2 is a plot showing measured ink jet current as a function of the stimulation amplitude;

FIG. 3 is a plot showing fractional charge imparted to satellite drops as a funcition of jet velocity; and FIG. 4 is a flow chart illustrating the steps in the method of adjusting ink jet pressure according to the present invention.

MODES OF CARRYING OUT THE INVENTION

Figure 1:
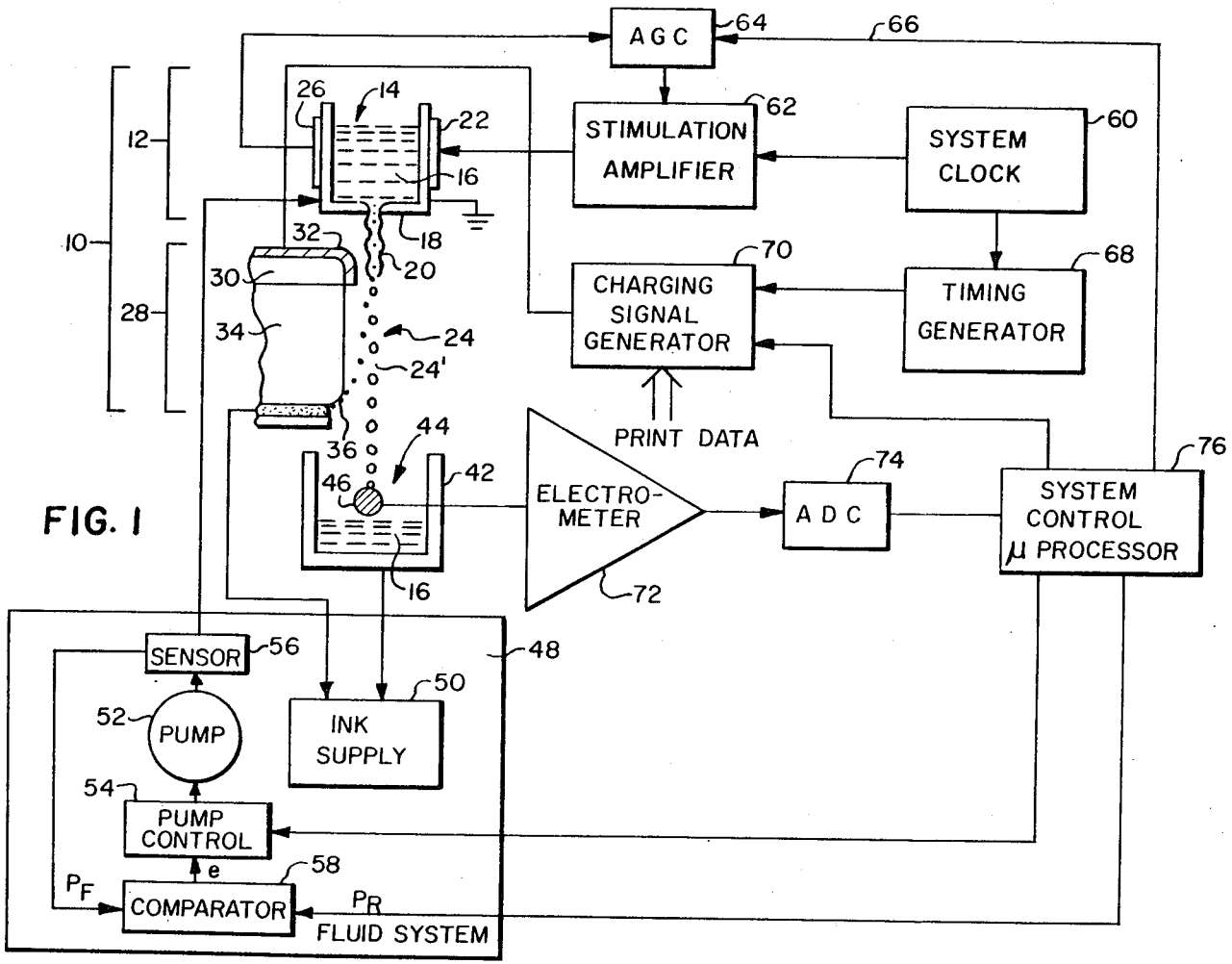
FIG. 1 is a schematic diagram showing an ink jet printing head and apparatus for adjusting ink pressure according to the present invention.

Referring to FIG. 1, a continuous binary ink jet printing head is shown schematically in cross section, along with associated electronics for practicing a preferred mode of the present invention. The printing head is of the type shown in published European Patent Application No. 0097413-A1 published Apr. 1, 1984 by H. Braun. The ink jet printing head 10 includes an upper head portion 12 defining an ink reservoir 14 containing, under pressure, conductive ink 16. The pressurized ink is forced through an orifice plate 18 to produce an ink filament 20.

A piezoelectric transducer 22 is mechanically coupled to the upper head portion 12 of the ink jet printing head for inducing mechanical vibrations in the upper head portion, and thereby in the ink, to stimulate controlled breakup of the ink filament into drops 24. A piezoelectric feedback transducer 26 measures the amplitude of stimulation imparted to the upper head portion 12 by the transducer 22.

The ink jet printing head includes a lower portion 28 having a charging plate 30, with a drop charging electrode 32 arranged adjacent the ink jet filament 20 for inducing charges on the ink drops 24 as they separate from the ink filament 20. Charged drops are deflected into the face of a drop catcher 34 where they are collected into an ink gutter 36 comprising a slot at the bottom of the drop catcher 34.

A nose cup 42 is provided at a storage and startup station (not shown) arranged at a suitable location within the ink jet printer. When the ink jet printing head 10 is not being used to print, it is positioned over the nose cup 42. The nose cup defines an ink sump 44 for receiving ink drops from the ink jet print head that are not sufficiently charged to be deflected onto the drop catcher 34. An electrometer electrode 46 is located in the nose cup 42 in a position to receive the electrical charge carried by the ink drops entering nose cup 42.

A fluid system 48, hydraulically connected to the print head 10, and nose cup 42, supplies the conductive ink, under pressure, to ink reservoir 14 in the upper head portion 12 of the printing head, recirculates the ink from the ink gutter 36 in the lower portion 28 of the ink jet printing head, and recirculates the ink from the sump 44 in the nose cup 42.

Fluid system 48 includes an ink supply 50 and a pump 52 for delivering pressurized ink from ink supply 50 to the print head reservoir 14. The pump 52 is controlled by a pump control circuit 54. A pressure sensor 56 monitors the ink pressure delivered by pump 52 and supplies an ink pressure feedback signal $P_F$ to a comparator 58. Comparator 58 receives an ink pressure reference signal $P_R$ from the system control electronics. The ink pressure reference signal $P_R$ is generated according to the present invention as described below. The comparator 58 compares the ink pressure feedback signal from pressure sensor 56 and the ink pressure reference signal, and produces an ink pressure error signal e which is supplied to the pump control circuit 54. The pump control circuit responds to the ink pressure error signal to control the ink pressure to the referenced level.

The ink jet printer electronics includes a system clock 60 that supplies a periodic clock signal (e.g., 75 KHz) to a stimulation amplifier 62. The output of the stimulation amplifier 62 is applied to the piezoelectric transducer 22 on the upper head portion 12 of the ink jet printing head 10. The gain of the stimulation amplifier, and hence the amplitude of the stimulation signal is controlled by an automatic gain control servo 64. The automatic gain control servo 64 receives a reference level signal on line 66, and a feedback signal from feedback transducer 26, and controls the gain of the stimulation amplifier such that the feedback signal matches the reference signal.

The clock signal from the system clock 60 is also provided to a timing generator 68 that produces timing pulses that determine the phase of the printing pulses that are applied to charging electrode 32. The timing pulses are applied to a charging signal generator 70 that receives a digital print data signal during printing and generates the printing pulses that are applied to the charging electrode 32.

An electrometer 72 is connected to the electrometer electrode 46, and generates an analog signal that is proportional to the ink jet current incident on the electrometer electrode 46. The analog output signal of the electrometer is supplied to an analog to digital converter 74 to produce a digital signal indicative of the ink jet current sensed by the electrometer 72.

A system control microprocessor 76 receives the digital ink jet current signal from the electrometer 72 and is programmed to generate the ink pressure reference signal $P_R$ as described below. The system control microprocessor also generates the reference signal that is supplied on line 66 to automatic gain control circuit 64 to control the gain of stimulation amplifier 62. The method of generating the amplifier gain control reference signal, which is not an essential part of the present invention, is described in copending U.S. patent application Ser. No. 765,972 filed Aug. 15, 1985 by Braun et al.

The general principle of operation of the present invention will now be described. The natural filament length of an unstimulated ink jet is relatively long, and the drop separation is not well behaved. As the stimulation amplitude is increased, the filament gets shorter. Eventually, slow satellite drops (small droplets occurring between the much larger main ink drops which travel slower than the main drops and hence are quickly overtaken and assumed into the main drops) are formed. As the stimulation amplitude is further increased, the speed of the satellites increases until a region is reached wherein the speed of the satellite droplets equals the speed of the main ink drops, and the satellite droplets remain separate from the main drops. This is called the infinite satellite region. A further increase in stimulation amplitude produces fast satellites (droplets that travel faster than the main drops, and hence overtake and are assumed by the main drops). It should be noted that the boundaries of these regions are not clearly defined, the general locations of the regions of satellite production are a function of ink temperature, pressure, viscosity and surface tension.

The present inventors have determined through experimentation that the relative size of the satellite drops produced in the infinite satellite region of operation is a function of the velocity of the ink jet, which in turn is a function of the ink pressure. Furthermore, it has been observed that the proportion of the charge imparted to the satellite droplets is a function of the relative size of the satellite drop to the main drop. Therefore, it has been discovered that if the relative fraction of a charge imparted to the satellite drops is measured, the measurement will provide a reliable indicator of ink jet velocity.

During drop charging, a charge is induced on the ink filament by the charging electrodes. When the filament breaks to from a drop, it acts as a mechanical switch to capture and isolate charge on the drops. The magnitude of the charges imparted to the satellite drops and the main drops are approximately proportional to the respective surface areas and hence a function of the squares of the radii of the resulting drops. The function is not exact due to the fact that the filament is more nearly a cylinder just prior to breaking and due to some arching that takes between drops and the filament at the instant the filment breaks.

On the other hand, the relative masses of the satellite and main drops are proportional to the respective volumes, and hence to the cubes of the radii of the drops. As a result, the charge to mass ratios of the main drops and the satellite drops are different, and vary approximately as an inverse function of the drop radius. The smaller satellite drops having a higher charge to the mass ratio than the main drops. This difference in charge to mass ratio between the satellite drops and the main drops is sufficient to allow separation of the satellite drop stream from the main drop stream in an ink jet printer.

This phenomena is employed to detect the velocity of the ink jet and adjust the ink pressure in the following manner. A relatively low charging voltage (e.g. 50 volts) insufficient to deflect the main drops into the catcher 34 is applied to the charging electrode 32. Then, while the stimulation amplitude is increased from a predetermined low value below the range of infinite satellite production, the ink jet current is monitored by electrometer 72. When the stimulation amplitude reaches the point where infinite satellite droplets are produced, the satellite droplets, with their higher charge to mass ratio, are deflected into the catcher. The measured ink jet current exhibits a sudden dip because some of the charge is being diverted to the catcher with the satellite droplets rather than being deposited on the electrometer electrode 46.

FIG. 2 shows a plot of the measured ink jet current vs. stimulation amplitude when a charge of 50 volts was placed on the charging electrode 32. At low stimulation amplitude, the measured ink jet current is small because the ink drops are breaking off downstream of the charging electrode 32, and therefore are not as strongly charged. As the stimulation amplitude is increased monotonically from a low value, the filament length shortens, and the ink jet current rises. At a certain point, infinite satellite drops are formed, and a portion of the charge is carried away by the satellite drops. The dip in ink jet current labelled A in FIG. 2 indicates the region of infinite satellite production. FIG. 1 shows how the infinite satellites 24' are deflected into the catcher while the main drops continue on to encounter the electrometer electrode 46.

When the ink pressure in the ink reservoir 14 is increased, the velocity of the ink jet increases and the proportion of charge carried away by the satellite drops increases. Consequently, the magnitude of the dip in ink jet current increases. This is illustrated by the phantom curves labelled B and C in FIG. 2, representing jet current vs. stimulation amplitude for increasing levels of ink pressure. FIG. 3 shows a plot of minimum jet current vs. ink jet velocity (and hence ink pressure) for an ink jet print head of the type shown in FIG. 1.

the method of sensing ink drop velocity and adjusting ink pressure according to the present invention will now be described with reference to the flow chart of FIG. 3. The ink jet printing head 10 is positioned over the nose cup 42 as shown in FIG. 1. The system control microprocessor 76 is programmed to output a nominal ink pressure reference value $P_R$. The microprocessor is also programmed to command the charging signal generator 60 to apply a low charging voltage (e.g. 50 volts) to the drop charging electrode 32, and to set stimulation amplitude at a predetermined low value by applying a low reference level to AGC circuit 64.

Next, the stimulation amplitude is monotonically increased while monitoring the ink jet current. The system control microprocessor 76 detects the minimum jet current $J_{min}$ at the first dip in ink jet current, and stores the minimum jet current. The ink pressure reference signal $P_R$ is calculated as a function of the detected minimum jet current according to the relation $$P_R = a \cdot J_{min} + b$$

where a and b are the slope and intercept respectively of the line shown in FIG. 3.

Although the invention has been described with reference to a binary type continuous ink jet printer, where the droplets are deflected along either a print or catch trajectory, it will be apparent that the invention can also be employed with a continuous ink jet printer of the type where the print drops can be deflected along a plurality of print trajectories. Furthermore, although the location of the elctrometer has been descried as sensing the charge carried by the main droplet stream, it will be apparent that the electrometer may be located to sense the charge carried by the satellite droplet stream. For example, the electrometer could be located in the ink gutter 36 of the ink jet print head 10 shown in FIG. 1.

INDUSTRIAL APPLICABILITY AND ADVANTAGES

The ink pressure adjustment method and apparatus is useful for automatically adjusting the ink pressure in a continuous ink jet printer to maintain a desired ink jet velocity. The method and apparatus have the advantage that the adjustment of the ink pressure automatically compensates for changes in ink viscosity to maintain the ink jet velocity constant. The method and apparatus has the further advantage that sensitive measurements of the ink velocity are accomplished without the need for interposing structure in the ink jet path near the deflection electrodes.

We claim:

1. Apparatus for adjusting ink pressure in a continuous ink jet printer to control ink drop velocity, characterized by:

means for charging the ink jet;

means for stimulating the ink jet to produce infinite satellite drops;

means for detecting the fractional charge imparted to the satellite drops and producing a signal representative of the detected fractional charge; and means responsive to said signal for adjusting the ink pressure as a function of detected fractional charge.

2. The apparatus for adjusting ink pressure claimed in claim 1, wherein said means for detecting the fractional charge imparted to satellite drops comprises an electrometer having an electrode located in the path of the main drops; and means for removing satellite drops from the main drops stream.

3. A method for adjusting ink pressure in a continuous ink jet printer to control ink jet drop velocity, characterized by the steps of charging the ink jet;

stimulating the ink jet to produce infinite satellite drops;

detecting the fractional charge imparted to the satellite drops;

adjusting the ink pressure as a function of the detected fractional charge.

* * * * *